United States Patent [19]

Jennings

[11] Patent Number: 4,561,413

[45] Date of Patent: Dec. 31, 1985

[54] COMPOUND BOW WITH IMPROVED LIMB TIP HANGER

[75] Inventor: Thomas P. Jennings, Sun Valley, Calif.

[73] Assignee: Kidde Recreation Products, Inc., Chicago, Ill.

[21] Appl. No.: 577,896

[22] Filed: Feb. 7, 1984

[51] Int. Cl.[4] ..... F41B 5/00

[52] U.S. Cl. ..... 124/23 R; 124/DIG. 1

[58] Field of Search ..... 124/23 R, 24 R, 86, 124/90, DIG. 1

[56] References Cited

U.S. PATENT DOCUMENTS

| | | | |
|---|---|---|---|
| 3,967,609 | 7/1976 | Frydenlund | 124/24 R |
| 4,060,066 | 11/1977 | Kudlacek | 124/23 R |
| 4,112,909 | 8/1978 | Caldwell | 124/23 R |
| 4,192,280 | 3/1980 | Rickard | 124/23 R |
| 4,244,346 | 1/1981 | Barna | 124/24 R |
| 4,300,521 | 11/1981 | Schmitt | 124/23 R |
| 4,370,972 | 2/1983 | Stewart et al. | 124/23 R |
| 4,372,285 | 2/1983 | Simonds et al. | 124/90 |
| 4,440,142 | 4/1984 | Simonds | 124/23 R |

*Primary Examiner*—Richard C. Pinkham
*Assistant Examiner*—Benjamin Layno
*Attorney, Agent, or Firm*—Emory L. Groff, Jr.

[57] ABSTRACT

A compound bow is provided with a hanger assembly for attaching wheels or cams and power cables to both bow limb tips and includes a pair of hanger members removably engageable with the distal portions of two split limb portions on each bow limb without the need for separate fastener members. A pair of side walls on each hanger member provide four laterally spaced apart points supporting a transverse axle adjacent each limb tip on the belly side of the limb. The axles in turn support the wheels or cams and respective ends of the power cables with the tension applied by the strung cables providing the sole force retaining each hanger assembly in place.

12 Claims, 4 Drawing Figures

COMPOUND BOW WITH IMPROVED LIMB TIP HANGER

This invention relates generally to archery bows and more particularly, to an improved attachment system for securing the ends of power cables and a wheel or cam adjacent each bow limb tip.

As is well known to those skilled in the art, the most popular form of compound bow includes one or more wheels or eccentric members pivotally attached relative each bow limb tip serving to support and control the movement of a bowstring which in turn is connected to or controls the displacement of a tension or power cable extending toward and connected adjacent each limb tip. The pivotal member supporting the wheel or cam includes a transversely disposed axle which must be suitably fixedly supported adjacent each limb tip and in most cases, this axle also serves as means for anchoring the distal portion of each power cable.

U.S. Pat. No. 4,372,285 issued Feb. 8, 1983 to Simonds et al depicts an example of an existing limb tip mounting arrangement wherein the cam axle is journaled within the material of the bow split limbs and each tension cable is affixed to the axle by means of a separate, adjustable anchor device. Such an arrangement necessitates the provision of a built-up structure for each split limb tip in order to provide suitable limb tip mass to accommodate and support the axle. Another common approach has been to employ a single U-shaped metal bracket at each bow limb tip as shown in U.S. Pat. No. 4,370,972, issued on Feb. 1, 1983 to Stewart et al. Such a bracket member must be affixed to each bow limb tip by a plurality of fasteners which many archers feel is objectionable since this requires drilling of holes through the bodies of the limb tips and the associated fasteners result in a concentration of the stresses subsequently applied during use of the bow. Additionally, these brackets are of substantial mass and an objective in constructing any archery bow is to minimize the amount of mass carried by limb tips in the interest in maintaining optimum efficiency and accuracy.

By the present invention, a compound bow limb tip hanger assembly is provided comprising a pair of hanger members associated with the two split limb portions at the ends of both bow limbs. Each hanger member comprises a rigid shaped element forming a removable boot or shoe within which each said limb portion is nested. Two depending side walls on each hanger member engage the two opposite side edges of each split limb portion and are provided with an aperture receiving one end of an axle upon which the wheel or cam is mounted. In this manner, each limb tip axle is supported at four spaced apart points with the wheel or cam medially mounted thereupon while the power cable end associated with each limb tip is suitably affixed to the same axle preferably by a yoke or bridle arrangement so that a symmetrical attachment of the power cable is achieved along the centerline of each bow limb.

The instant hanger members obviate the necessity of building up the thickness of the limb tips such as with tip blocks and avoid the use of any separate fastening members for attaching the hanger members to the limbs. Each hanger member is securely maintained in place by its mating engagement with four surfaces of each split limb portion and supports the cam or wheel axle along an axis which is disposed below or inside the plane of the limb instead of above or outside that plane. With this construction, no tools are required to disassemble or remove the structure associated with each pair of hanger members at each limb tip since the normal tension of a bow strung with the present invention maintains the hanger members in the proper use relationship with the two limb tips.

Accordingly, one of the objectsof the present invention is to provide an improved limb tip hanger for compound bows including for each limb a pair of shaped hanger members each having a plurality of walls disposed in mating engagement with a plurality of surfaces of each one of a pair of split limb portions with a transverse axle containing a wheel or eccentric supported by the axle between each pair of hanger members.

A further object of the present invention is to provide an improved compound bow limb tip hanger assembly including a separate hanger member insertable over each one of a pair of split limb portions and adapted to support an axlemounted wheel or cam without any separate fastening elements retaining the hanger members in their use position.

Still another object of the present invention is to provide an improved limb tip hanger assembly for a compound bow including a shaped hanger member on each of a pair of split limb portions of the bow limbs and having a pair of depending side walls through which a wheel or cam-containing axle is mounted with an end wall on each hanger member bearing upon each split limb portion end surface to retain the hanger members in place by tension of the strung bowstring and power cables without the use of separate fastener elements.

With these and other objects in view which will more readily appear as the nature of the invention is better understood, the invention consists in the novel construction, combination and arrangement of parts hereinafter more fully described, illustrated and claimed with reference being made to the attached drawing wherein:

Similar reference characters designate corresponding parts throughout the several figures of the drawing.

Figure 1:
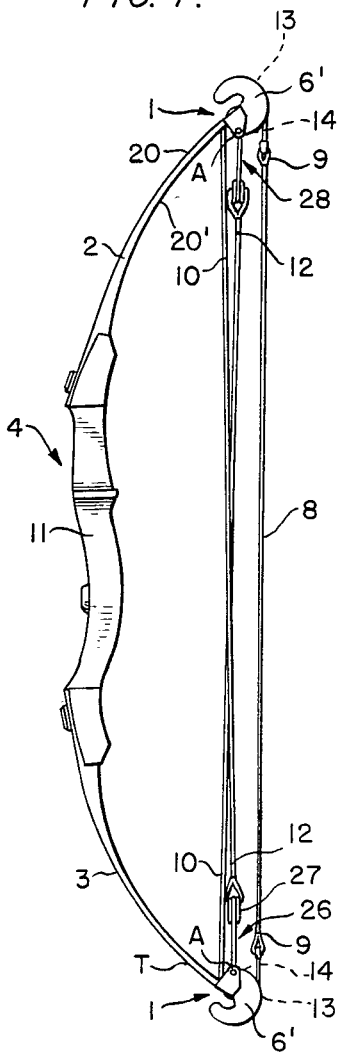
FIG. 1 is a side elevation of a typical compound bow provided with limb tip hangers according to the present invention.
Figure 4:
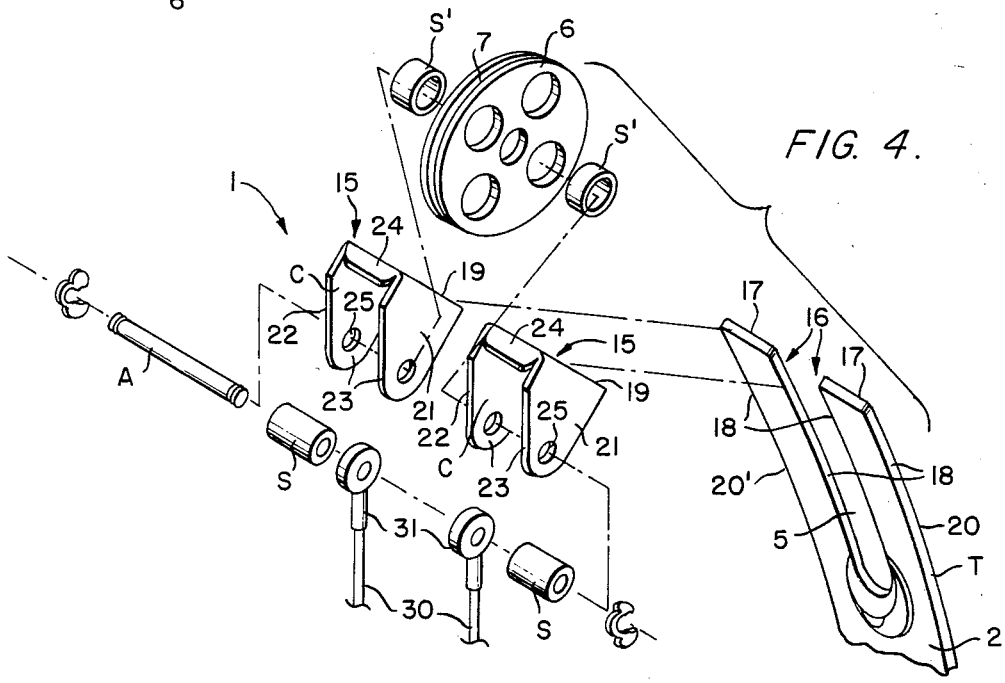
FIG. 4 is an exploded, enlarged perspective view of the hanger assembly of FIG. 1 in combination with an alternate rotatable member.

Referring now to the drawing, particularly FIG. 1, the present invention will be seen to comprise a limb tip hanger assembly generally designated 1, associated with each free end or tip T of the upper limb 2 and lower limb 3 of a typical compound bow 4. The distal portion of each limb 2,3 is split as shown in FIG. 4 to provide a medial crotch 5 for the purpose of accommodating a portion of either a concentric wheel 6 or an eccentrically-mounted wheel or cam 6'.

The rotatable member supported by each hanger assembly 1 may comprise either a concentric or eccentric element having one or more grooves or cable tracks 7, the latter of which may be disposed as either a single track, a single or dual overlapping tracks, adjacent parallel tracks or a spiral track, as is well known in the art. A bowstring 8 spans the distance between the two spaced apart members 6—6 or 6'—6' and the opposite ends 9 thereof are each joined to a tension or power cable 10.

At this point, it should be understood that the specific arrangement of the power cables as well as the particular construction of the bow limbs and the intermediate handle section 11 may vary in any compound bow 4 intended to incorporate the hanger assembly 1 of the present invention. For the purpose of understanding the present limb tip hangers, a basic cable arrangement is illustrated wherein a single stretch of power cable 10 extends from each rotatable member 6 or 6' carried by one limb 2 or 3, and terminates with its end 12 anchored adjacent an opposite limb tip. In this respect, a planar cam 6' is illustrated in the embodiment of FIG. 1 as having a planar overlapping bowstring track 13 and power cable track 14. Quite obviously, alternate wheel-/eccentric structure may be employed in combination with the hanger assembly 1 and one or more pairs of additional wheels or pulleys (not shown) may be attached to the limbs and/or handle section as is well known in the art. In the same manner, the cam 6' may be replaced by a concentric wheel 6 as shown in the embodiment of FIG. 4 with one or more cam elements attached to the bow limbs and/or handle section. Accordingly, it will be appreciated that compound bows incorporating the present invention may utilize numerous types of rotatable elements without departing from the spirit of the invention.

Figure 2:
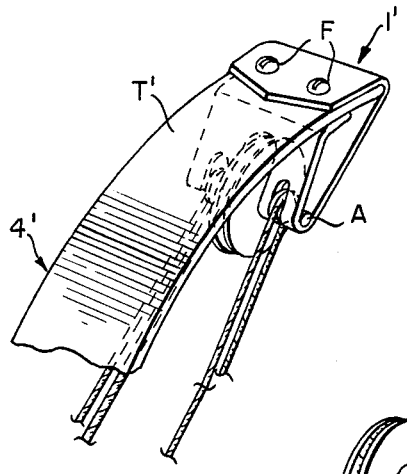
FIG. 2. (PRIOR ART)
FIG. 2 is a fragmentary perspective view of a prior art hanger arrangement.
Figure 3:
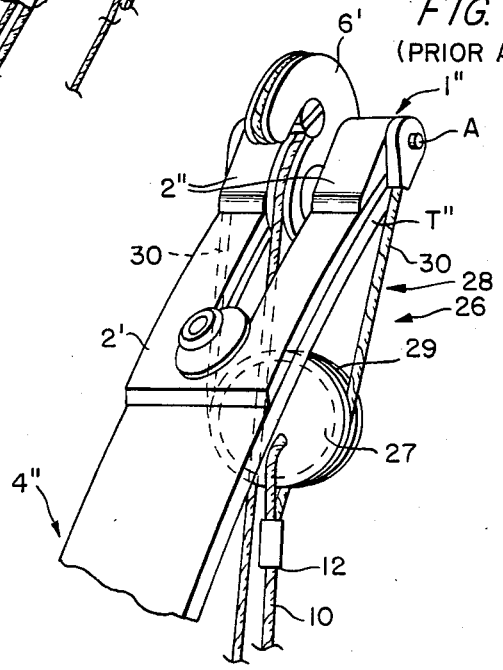
FIG. 3. (PRIOR ART)
FIG. 3 is a fragmentary perspective view of another prior art hanger arrangement.

FIGS. 2 and 3 of the drawing illustrate examples of prior efforts for attaching rotatable wheels or cams and power cable ends adjacent each limb tip of two compound bows. In the bow 4' of FIG. 2, the tip T' is not split and a unitary hanger fixture 1' is used for mounting an axle which supports the rotatable member and power cable ends. This fixture 1' is attached to the limb tip T' by means of separate fasteners F—F requiring prior boring of holes in each limb tip. In the alternative prior art arrangement of FIG. 3, a hanger assembly 1" is shown wherein the split limb tip T" is built-up by the lamination of the additional layer 2' and two tip blocks 2"—2", the latter supporting the axle upon which the cam and power cable ends are affixed. Both of these earlier attempts provide hanger assemblies which require manufacturing and assembly steps avoided by the instant invention. Either precisely located holes must be drilled followed by the individual application of a plurality of fasteners or an additional limb lamination and tip blocks must be fabricated and adhesively attached to a limb tip to provide means for receiving the cam/cable axle.

Supporting each wheel or cam 6—6' and the end 12 of each power cable 10 is an axle A in turn supported by each hanger assembly 1. Each hanger assembly will be seen most clearly from FIG. 4 to include a pair of hanger members 15—15 of identical construction and which comprise a boot or shoe device preferably constructed of metal and formed to provide a close mating fit over each one of the pair of split limb portions 16—16 at the end of each bow limb 2,3. Each split limb portion 16 will be seen to be of substantially constant thickness in the area adjacent its end surface 17 and includes a pair of side surfaces 18—18 which likewise defines a substantially constant width in the area adjacent the end surface 17.

The construction of each hanger member 15 is such that an internal cavity C is formed therein which provides a close mating fit with respect to four surfaces of each split limb portion 16. A back wall 19 is configured to overlie the back surface 20 of either limb portion 16 while a first and second side wall 21,22 depend from the lateral edges of the back wall 19 and terminate in an end axle section 23 well spaced from the back wall 19. An end wall 24 projects downwardly from the top of the back wall 19 and spans the distance between the two opposite side walls 21–22.

With the foregoing structure in mind, it will be appreciated that each hanger member 15 may be readily slipped over either split limb 16 into the position such as shown in FIG. 1 with each end wall 24 thereof abutting the respective split limb portion end surface 17. With the two identical hanger members 15—15 thus positioned at the end of each limb 2 or 3, a wheel or cam 6,6' is supported therebetween by means of the axle A which is suitably journaled between two pairs of transversely aligned axle holes 25 formed in the side walls 21–22 of each hanger member 15 whereby a four-point suspension is provided for each axle with the support therefor being provided in an equalizing manner relative the two limb portions 16—16 and the limb centerline.

Each power cable end 12 is suitably affixed to the same axle A supporting each wheel or cam 6—6' and this power cable attachment is preferably achieved by means of a yoke assembly 26 so as to provide a symmetrical anchor of the power cables with respect to each limb centerline.

Such a yoke assembly 26 may include a disc 27 to which each power cable end 12 is appropriately attached and a U-shaped bridle cable 28 is disposed within a peripheral groove 29 of the disc 27 with each bridle cable segment 30 having an end fitting 31 pivotally mounted upon the Axle A, preferably within the confines defined by the two side walls 21–22 of each hanger member 15. Appropriate spacers S—S axially position the end fittings 31—31 while spacers S'—S' likewise axially position the wheel or cam upon the axle A to maintain the various components symmetrical relative the limb centerline.

With the bow strung as shown in FIG. 1 of the drawing, the inherent tension applied by the bowstring 8 and power cables 10—10 will be understood to provide the only means necessary to insure retension of the the two hanger assemblies 1—1 in the position as shcwn in FIG. 1 with the axles A located adjacent the belly surface 20' of each limb.

The improved hanger assembly yields a vastly superior arrangement exhibiting strength, rigidity and durability not evident with known devices associated with compound bows. The increased stability provided the rotatable cams or wheels not only improvesthe resistance against twisting and splitting of the limb tips but also yields a greater "repeatability" or consistency between shots. Additionally, the very construction of the hanger members 15 which is critical for their functioning as stated herein, also assists in offering protection to the bow limb tips T. Should the bow be dropped, such as from a high tree stand, the hanger member and walls 24 end side walls 21–22 have been found to provide significant protection against damage to the tips.

I claim:

1. In an archery bow provided with a pair of limbs each having a pair of split limb portions defining a crotch therebetween, each said split limb portion including opposite side surfaces, a back surface, a belly surface and an end surface, a rotatable member supported adjacent each said pair of split limb portions, a pair of power cables each having one end terminating adjacent one said pair of split limb portions, a bowstring spanning said rotatable members; the improvement comprising, a limb tip hanger assembly mounted on each said pair of split limb portions, each said hanger assembly including a pair of separate detachable hanger members void of any permanent rigid connection between one another, each said hanger member having a plurality of walls respectively overlying a plurality of said surfaces of each said split limb portion, said walls of each said hanger member including a pair of side walls respectively overlying said opposite side surfaces of each said split limb portion, a removable axle mounted through said side walls and spanning each pair of said hanger members, one said rotatable member carried by each said axle between each two of said hanger members of each said pair of hanger members, means respectively attaching said one end of each said power cable to each one of said axles whereby, with said bow in a strung condition the tension applied by said bowstring and power cables maintains the two separate hanger members of each said hanger assembly attached in a fixed relationship upon the respective split limb portions solely by the application of pressure upon at least one said hanger member wall against one said split limb portion surface.

2. An archery bow according to claim 1 wherein, each said hanger member comprises an integral shaped-metal element.

3. An archery bow according to claim 1 wherein, said rotatable members each comprise a wheel.

4. An archery bow according to claim 3 wherein, said wheels are concentrically mounted upon said axles.

5. An archery bow according to claim 1 wherein, said rotatable members each comprise a cam.

6. An archery bow according to claim 4 wherein, said cams include a single planar string/cable axles.

7. An archery bow according to claim 1 wherein, said hanger member walls include an end wall at least partially overlying a respective one said split limb portion end surface.

8. An archery bow according to claim 7 including, a back wall on each said hanger member overlying a respective one said back surface of each said split limb portion.

9. An archery bow according to claim 1 wherein, said power cable attaching means each includes a yoke assemby having a pair of end fittings joined to one said axle.

10. An archery bow according to claim 9 wherein, each one of said pair of end fittings is disposed between a respective pair of said side walls of each said hanger member.

11. An archery bow according to claim 1 wherein, said power cables include another end joined to a respective one said rotatable member.

12. An archery bow according to claim 1 wherein, said axles are disposed removed from the plane of said limbs juxtaposed said split limb portion belly surface.

* * * * *